US006874456B2

(12) United States Patent
Yamada et al.

(10) Patent No.: US 6,874,456 B2
(45) Date of Patent: Apr. 5, 2005

(54) VALVE OPERATING APPARATUS OF INTERNAL COMBUSTION ENGINES

(75) Inventors: Yoshihiko Yamada, Kanagawa (JP); Katsuhiko Uchida, Kanagawa (JP)

(73) Assignee: Hitachi, Ltd., Tokyo-to (JP)

( * ) Notice: Subject to any disclaimer, the term of this patent is extended or adjusted under 35 U.S.C. 154(b) by 0 days.

(21) Appl. No.: 10/795,263

(22) Filed: Mar. 9, 2004

(65) Prior Publication Data

US 2004/0187822 A1 Sep. 30, 2004

(30) Foreign Application Priority Data

Mar. 27, 2003 (JP) ..... 2003-086745

(51) Int. Cl.[7] ..... F01M 1/06

(52) U.S. Cl. ..... 123/90.36; 123/90.34; 123/90.39; 123/90.44

(58) Field of Search ..... 123/90.12, 90.13, 123/90.16, 90.17, 90.27, 90.31, 90.39, 90.41, 90.44, 90.34, 90.36; 74/559, 569, 567

(56) References Cited

U.S. PATENT DOCUMENTS 4,662,323 A * 5/1987 Moriya ..... 123/90.23
6,125,806 A * 10/2000 Nishi et al. ..... 123/90.27
6,382,150 B1 * 5/2002 Fischer ..... 123/90.16
6,470,841 B2 * 10/2002 Takahashi et al. ..... 123/90.33

FOREIGN PATENT DOCUMENTS

JP 2001-55915 A 2/2001

* cited by examiner

*Primary Examiner*—Thomas Denion
*Assistant Examiner*—Ching Chang
(74) *Attorney, Agent, or Firm*—Foley & Lardner LLP

(57) ABSTRACT

In a valve operating apparatus, torque is transmitted from an eccentric drive cam attached to a drive shaft through a multinodular-link motion-transmission mechanism including a link arm, a rocker arm, and a link rod to a rockable cam to cause an engine valve to open and close. Also provided is a control cam whose geometric center is displaced from a control shaft. By way of eccentric rotary motion of the control cam, a valve lift of the engine valve is variably controlled. Lubricating oil supplied from an oil passage formed in the drive shaft via a first communicating passage formed in the drive cam into a clearance between the link arm and the drive cam, is forcibly fed via a second communicating passage into a pivotally linked portion between the link arm and the rocker arm by oscillatory pumping action created by eccentric rotary motion of the drive cam.

20 Claims, 5 Drawing Sheets

VALVE OPERATING APPARATUS OF INTERNAL COMBUSTION ENGINES

TECHNICAL FIELD

The present invention relates to a valve operating apparatus of an internal combustion engine that opens and closes engine valves such as intake and exhaust valves, and specifically to the improvement of a lubricating system of an engine valve operating apparatus that supplies valve-operating-mechanism moving parts such as a drive cam, a link arm, and a rocker arm with lubricating oil to prevent actual contact between any of the moving metal surfaces and to enhance the lubricating performance for a mechanically-linked portion between the drive cam and the link arm and a pivotally linked portion between the link arm and the rocker arm.

BACKGROUND ART

In recent years, there have been proposed and developed various valve operating apparatus with multinodular-link motion-transmission mechanisms each containing a plurality of motion-transmitting links, for example, a rocker arm, a link arm, a link rod, and the like. One such multinodular-link motion-transmission mechanism equipped valve operating apparatus has been disclosed in Japanese Patent Provisional Publication No. 2001-55915 (hereinafter is referred to as "JP2001-55915"). The valve operating apparatus disclosed in JP2001-55915 is exemplified in an internal combustion engine with a continuous variable valve event and lift (VEL) control system capable of simultaneously operating a pair of intake valves per cylinder. In the multinodular-link motion-transmission mechanism equipped valve operating apparatus disclosed in JP2001-55915, a drive cam is fixed onto the outer periphery of a drive shaft rotating in synchronism with rotation of an engine crankshaft, such that the axis of the drive cam is displaced from the axis of the drive shaft. A sleeve-like camshaft is coaxially and rotatably fitted to the outer periphery of the drive shaft. The sleeve-like camshaft is formed integral with a pair of rockable cams associated with the respective intake valves. Input torque is transmitted from the drive cam (output member) through a multinodular-link motion-transmission mechanism to the two rockable cams (input members), so as to open and close the intake valves via a pair of valve lifters. The multinodular-link motion-transmission mechanism is comprised of at least a rocker arm, a link arm, and a link rod. The rocker arm is located above the rockable cams and rockably supported on an eccentric cam (a cylindrical cam) with the shaft displaced from its geometric center. The link arm is rotatably linked at one end to the drive cam and rotatably linked at the other end to one end of the rocker arm. The link rod is rotatably linked at one end to the other end of the rocker arm and rotatably linked at the other end to the tip end of the cam-nose portion of one of the rockable cams. In the valve operating apparatus of JP2001-55915, a plurality of needle-bearing rollers are interleaved between the inner peripheral surface of the drive-cam retaining bore of the link arm and the outer peripheral surface of the drive cam so as to ensure smooth relative rotation between the link arm and the drive cam. In order to provide a lubricating-oil supply circuit for moving parts of the valve operating apparatus, various oil holes and passages are formed. For instance, a radial oil hole is formed in the drive cam in such a manner as to communicate with an axial oil passage formed in the drive shaft. A radially-extending oil passage is formed in the link arm such that the link-arm oil passage opens at the innermost end via the inner peripheral wall surface of the drive-cam retaining bore of the link arm to the clearance space between the inner periphery of the link arm and the outer periphery of the drive cam and also opens at the outermost end to the pivotal portion linked to the rocker arm, in other words, the clearance space between the outer periphery of the rocker-arm connecting pin and the inner periphery of the link-arm pin hole. With the previously-discussed lubricating-oil supply circuit, lubricating oil is supplied through the axial oil passage of the drive shaft via the radial oil hole of the drive cam to the spaces between the needle-bearing rollers, and then supplied into the pivotally linked portion (the clearance between the outer periphery of the rocker-arm connecting pin and the inner periphery of the link-arm pin hole) through the link-arm oil passage for lubricating purposes.

SUMMARY OF THE INVENTION

However, in the lubricating-oil supply circuit for the valve operating apparatus as disclosed in JP2001-55915, owing to the use of a plurality of needle-bearing rollers interleaved between the inner periphery of the drive-cam retaining bore of the link arm and the outer periphery of the drive cam, lubricating oil, which is delivered from the axial oil passage of the drive shaft through the radial oil hole of the drive cam around between the needle-bearing rollers and adhered onto the outer peripheral surfaces of the needle-bearing rollers rotating in contact with each other, tends to be carried or forced out in the opposite axial directions of the drive cam. In particular, when the engine is restarted or during initial operation or during cold-weather starting so that the lubricating oil does not channel as the needle bearing rollers begin to rotate, the needle bearing rollers tend to cut out channels in the lubricating oil. This results in a remarkable lack in lubricating-oil supply to the link-arm oil passage, that is, a remarkable lack of lubricating oil to be supplied to the clearance space between the outer periphery of the rocker-arm connecting pin and the inner periphery of the link-arm pin hole, thus lowering the lubricating performance. In the lubricating-oil supply circuit of the valve operating apparatus disclosed in JP2001-55915, the link-arm oil passage is formed as a radial oil passage perpendicular to the drive-shaft axial oil passage. In other words, the link-arm oil passage is formed in the vertical direction. Therefore, even when a small amount of lubricating oil has been flown into the link-arm oil passage, there is an increased tendency for the lubricating oil to flow back to the spaces defined between the two adjacent needle-bearing rollers owing to a dead load of the lubricating oil. This causes a further lack in lubricating oil for the clearance between the outer periphery of the rocker-arm connecting pin and the inner periphery of the link-arm pin hole. Thus, it would be desirable to provide an improved lubricating-oil supply means by which an enhanced lubricating performance may be realized and smooth motion and reduced wear of each of links constructing a multinodular-link motion-transmission mechanism incorporated in a valve operating apparatus may be assured without requiring the addition of a needle bearing between the two adjacent moving links.

Accordingly, it is an object of the invention to provide a valve operating apparatus of an internal combustion engine, capable of ensuring an enhanced lubricating performance (adequate lubrication, lubricating-oil holding performance, more efficient lubrication, quick lubricating oil supply during an engine restarting period) for valve-operating-mechanism moving parts such as a drive cam, a link arm, a rocker arm, and the like.

In order to accomplish the aforementioned and other objects of the present invention, a valve operating apparatus of an internal combustion engine for causing an engine valve to open and close, comprises a drive shaft having an oil passage formed therein, a drive cam, which is integrally fixed to an outer periphery of the drive shaft and whose axis is eccentric to an axis of the drive shaft, a link arm formed at one end with a bore rotatably fitted onto an outer peripheral surface of the drive cam, a rocker arm having a first armed portion that is rotatably fitted to the other end of the link arm via a pivotally linked portion between the link arm and the rocker arm, and a second armed portion through which the engine valve is opened and closed by oscillating motion of the rocker arm, a lubricating system comprising a first communicating passage formed in the drive cam and having a first opening end communicating the oil passage formed in the drive shaft, and a second communicating passage formed in the link arm and having a first opening end opening to an inner peripheral surface of the bore of the link arm for proper fluid communication with a second opening end of the first communicating passage, and having a second opening end opening to the pivotally linked portion between the link arm and the rocker arm, and a clearance space defined between the outer peripheral surface of the drive cam and the inner peripheral surface of the bore of the link arm is formed as a crescent-shaped clearance except an area of maximum loading during rotary motion of the drive cam.

According to another aspect of the invention, a valve operating apparatus of an internal combustion engine for causing an engine valve to open and close, comprises a drive shaft having an oil passage formed therein, a drive cam, which is integrally fixed to an outer periphery of the drive shaft and whose axis is eccentric to an axis of the drive shaft, a link arm formed at one end with a bore rotatably fitted onto an outer peripheral surface of the drive cam, a rocker arm having a first armed portion that is rotatably fitted to the other end of the link arm via a pivotally linked portion between the link arm and the rocker arm, and a second armed portion through which the engine valve is opened and closed by oscillating motion of the rocker arm, a lubricating system comprising a first communicating passage formed in the drive cam and having a first opening end communicating the oil passage formed in the drive shaft, and a second communicating passage formed in the link arm and having a first opening end opening to an inner peripheral surface of the bore of the link arm for proper fluid communication with a second opening end of the first communicating passage, and having a second opening end opening to the pivotally linked portion between the link arm and the rocker arm, and the outer peripheral surface of the drive cam is in sliding-contact directly with the inner peripheral surface of the bore of the link arm, and lubricating oil supplied from the oil passage through the first communicating passage into a clearance space defined between the outer peripheral surface of the drive cam and the inner peripheral surface of the bore of the link arm is forcibly supplied into the second communicating passage by an oscillatory pumping action created by eccentric rotary motion of the drive cam within the bore of the link arm.

According to a further aspect of the invention, a valve operating apparatus of an internal combustion engine for causing an engine valve to open and close, comprises a drive shaft having an oil passage formed therein, a drive cam, which is integrally fixed to an outer periphery of the drive shaft and whose axis is eccentric to an axis of the drive shaft, a link arm formed at one end with a bore rotatably fitted onto an outer peripheral surface of the drive cam, a rocker arm having a first armed portion that is rotatably fitted to the other end of the link arm via a pivotally linked portion between the link arm and the rocker arm, and a second armed portion through which the engine valve is opened and closed by oscillating motion of the rocker arm, a lubricating system comprising first communicating passage means formed in the drive cam and having a first opening end communicating the oil passage formed in the drive shaft for lubricating a clearance space defined between the outer peripheral surface of the drive cam and an inner peripheral surface of the bore of the link arm, and second communicating passage means formed in the link arm and having a first opening end opening to the inner peripheral surface of the bore of the link arm for proper fluid communication with a second opening end of the first communicating passage means, and having a second opening end opening to the pivotally linked portion between the link arm and the rocker arm for lubricating the pivotally linked portion between the link arm and the rocker arm, and the outer peripheral surface of the drive cam is in sliding-contact directly with the inner peripheral surface of the bore of the link arm, and lubricating oil supplied from the oil passage through the first communicating passage means into the clearance space defined between the outer peripheral surface of the drive cam and the inner peripheral surface of the bore of the link arm is forcibly supplied into the second communicating passage means by an oscillatory pumping action created by eccentric rotary motion of the drive cam within the bore of the link arm.

The other objects and features of this invention will become understood from the following description with reference to the accompanying drawings.

DESCRIPTION OF THE PREFERRED EMBODIMENTS

Figure 1:
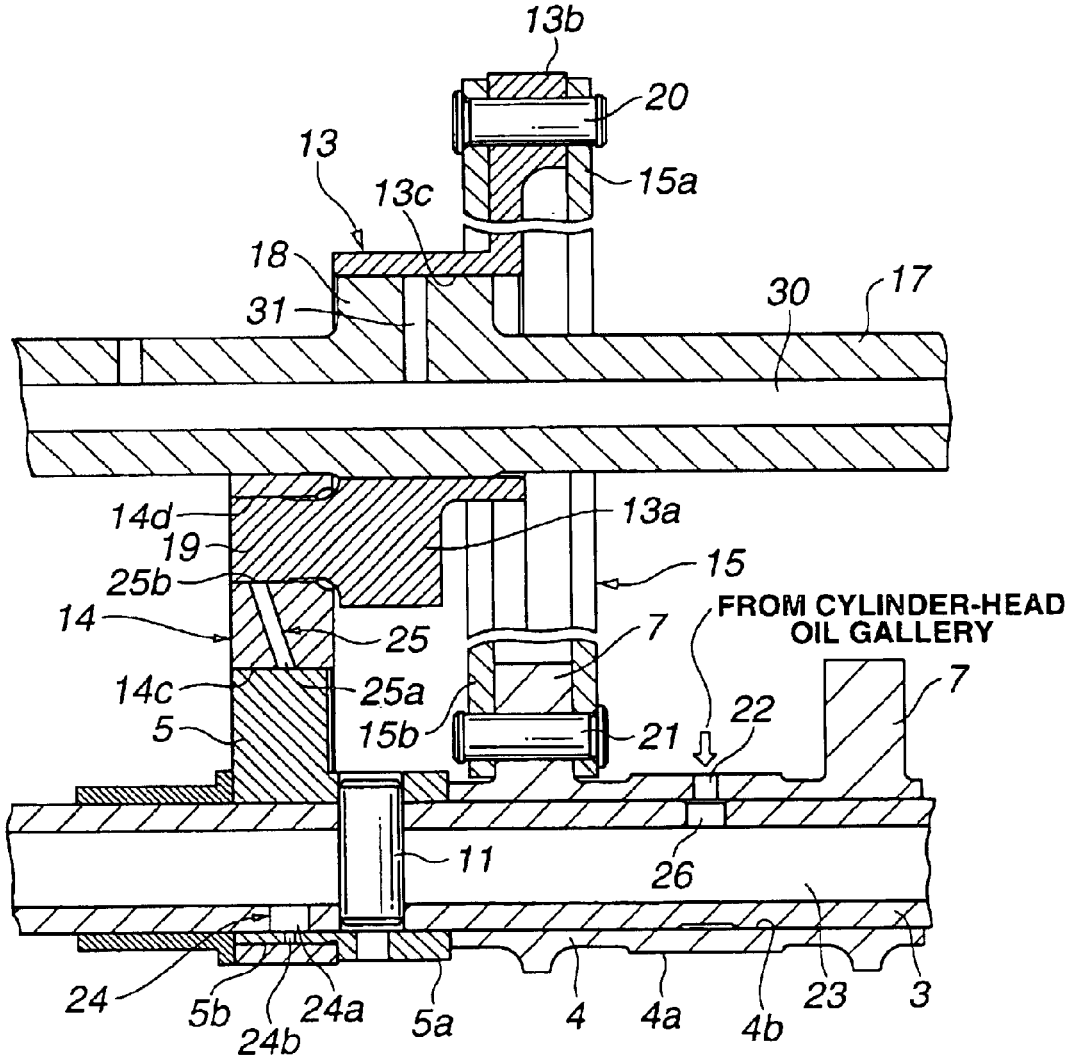
FIG. 1 is a longitudinal cross-sectional view illustrating an embodiment of a valve operating apparatus having an improved lubrication system.
Figure 5:
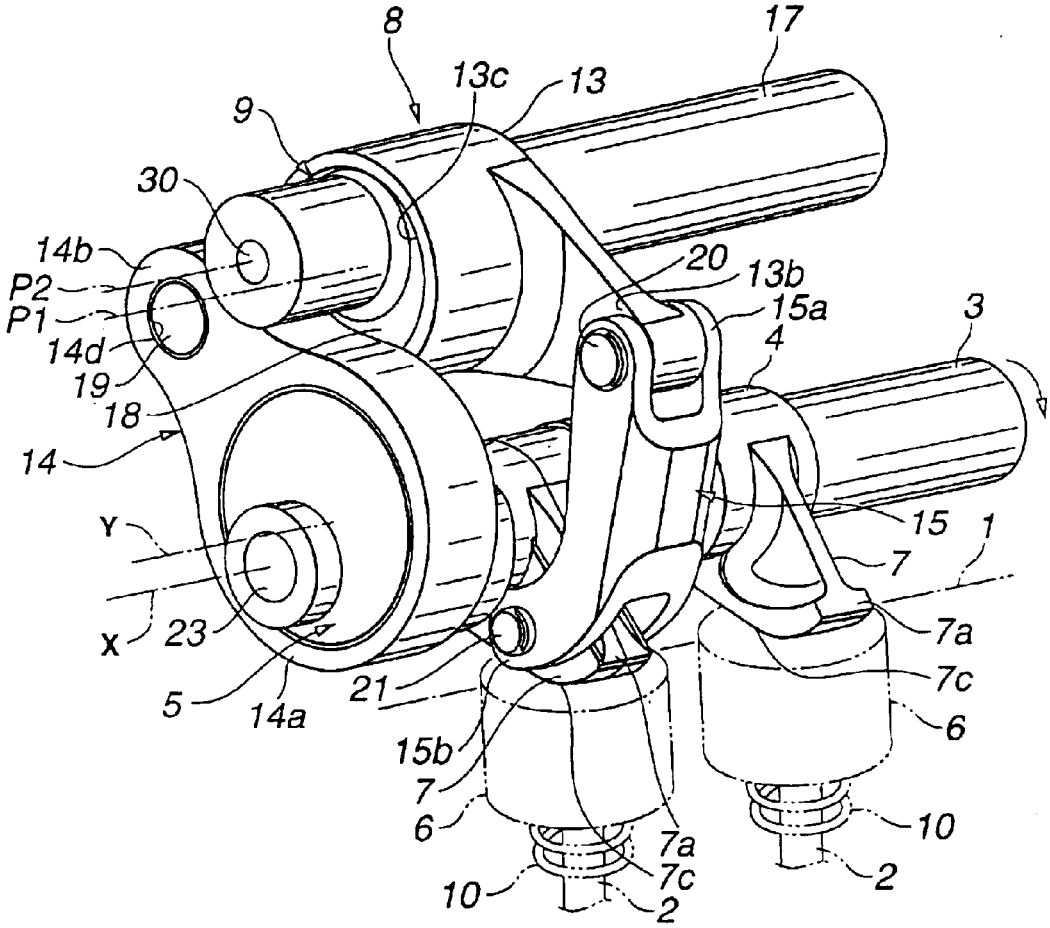
FIG. 5 is a perspective view showing the valve operating apparatus of the embodiment.
Figure 6:
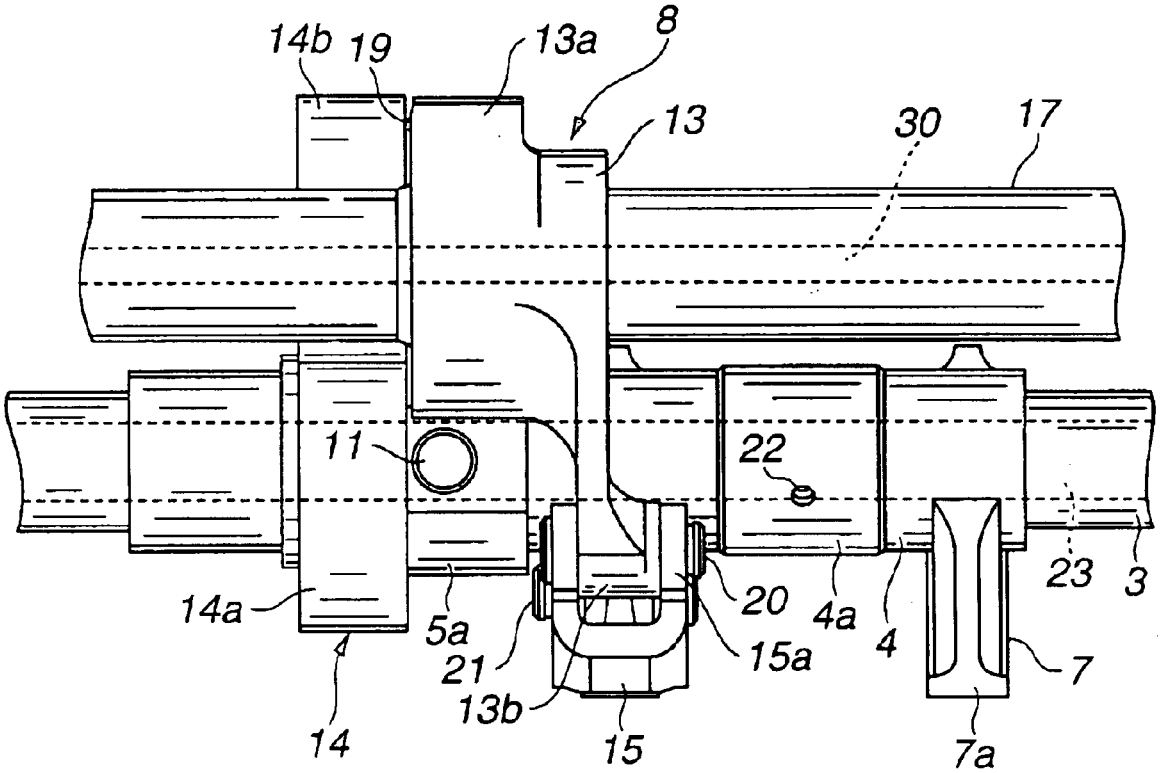
FIG. 6 is a plan view showing the valve operating apparatus of the embodiment.

Referring now to the drawings, particularly to FIG. 1, the valve operating apparatus of the embodiment is exemplified in an internal combustion engine with a continuous variable valve event and lift (VEL) control system capable of simultaneously operating a pair of intake valves 2, 2 per cylinder and continuously varying both of a working angle (or a lifted period) and a valve lift (valve lifting height) of each of intake valves 2, 2, depending on engine operating conditions. As shown in FIGS. 1, 5, and 6, the valve operating apparatus of the embodiment is comprised of intake valves 2, 2 slidably mounted on a cylinder head 1 (see FIG. 5) through respective valve guides (not shown), a cylindrical-hollow drive shaft 3 extending in the longitudinal direction of the engine and serving as a camshaft support, a sleeve-like camshaft 4 rotatably coaxially supported on the outer peripheral surface 3*a* of drive shaft 3 and provided for each individual engine cylinder, a drive cam 5 integrally fixed to drive shaft 3 in place, a pair of valve lifters 6, 6 for the respective intake valves, a pair of rockable cams 7, 7 in sliding-contact with the respective valve lifters 6, 6 to open and close intake valves 2, 2, a multinodular-link motion-transmission mechanism 8 through which drive cam 5 and one of rockable cams 7, 7 are mechanically linked to each other to convert input torque (rotary motion) of drive cam 5 into up-down motion of each intake valve 2 (oscillating motion of each rockable cam 7), and a control mechanism 9 that changes an initial actuated position of multinodular-link motion-transmission mechanism 8.

Each of a pair of valve springs 10, 10, associated with the respective intake valves 2, 2, is operably disposed between a cylindrically-bored valve-spring seat portion of the upper side of cylinder head 1 and a spring retainer attached to the tip end of the intake-valve stem, such that the spring bias forces the associated intake valve to remain closed.

Drive shaft 3 is arranged in the longitudinal direction of the engine. Both ends of drive shaft 3 is rotatably supported by means of drive-shaft bearing members (not shown) mounted on cylinder head 1. Although it is not clearly shown, a driven sprocket is fixedly connected to the axial end of drive shaft 3 and is driven by means of a timing chain (not shown). As seen from the perspective view of FIG. 5, drive shaft 3 rotates in the rotation direction indicated by the arrow in synchronism with rotation of an engine crankshaft.

Camshafts 4, divided for each individual engine cylinder, are substantially cylindrical in shape in a manner so as to extend in the axial direction of drive shaft 3. A supported or fitted bore (an axial through opening or an axial bore) 4*b* is formed in the cylindrical-hollow camshaft 4 such that each camshaft 4 is rotatably supported on the outer peripheral surface of the same drive shaft 3. Each camshaft 4 is formed integral with a large-diameter cylindrical journal portion 4*a* substantially at a midpoint of the camshaft. Journal portion 4*a* of camshaft 4 is rotatably supported by means of cam bearing members (not shown). The inner peripheral surface of axial bore 4*b* of camshaft 4 is rotatably fitted onto the outer peripheral surface of drive shaft 3.

Figure 2:
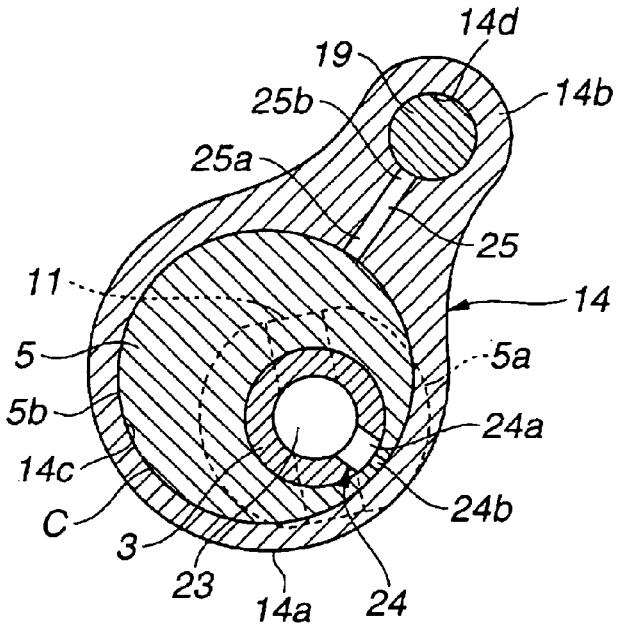
FIG. 2 is an explanatory lateral cross section showing a fluid-communication blocked state (or a misaligned drive-cam rotary position) in which fluid communication between first and second communicating passages is blocked.
Figure 3:
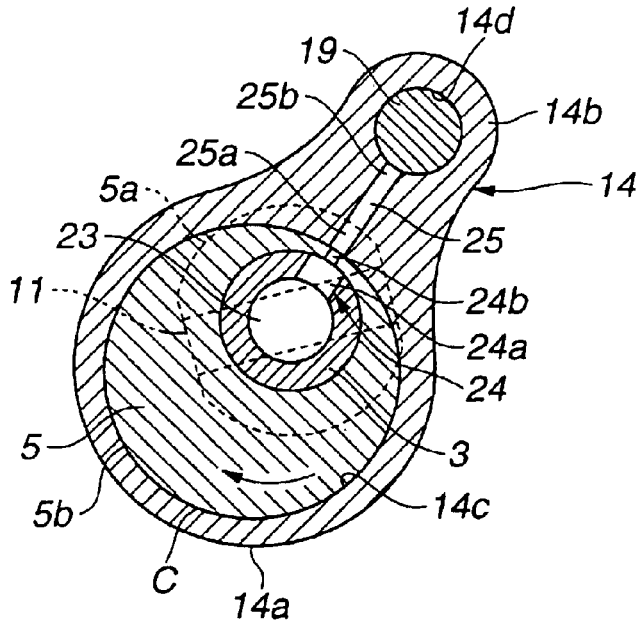
FIG. 3 is an explanatory lateral cross section showing a fluid-communication established state (or an aligned drive-cam rotary position) in which fluid communication between the first and second communicating passages is established.

As shown in FIGS. 1–6, drive cam 5 is substantially disk-shaped. One side of drive cam 5 is formed integral with an axially-protruding cylindrical portion 5*a* (see FIGS. 1–4 and 6). Drive cam 5 is fixedly connected to drive shaft 3 by securing the axially-protruding cylindrical portion 5*a* onto drive shaft 3 in place via a securing pin 11. Drive cam 5 is an eccentric cam. As best seen in FIGS. 2, 3, and 5, the outer peripheral surface 5*b* of drive cam 5 is formed as a circular cam profile. The axis (the geometric center) Y of drive cam 5 is displaced a predetermined eccentricity or a predetermined distance or a predetermined offset (see FIG. 5) from the axis X of drive shaft 3.

As shown in FIG. 5, each rockable cam 7 has a raindrop shape. The base-circle portion of rockable cam 7 is integrally formed with or integrally connected to camshaft 4, to permit oscillating motion of rockable cam 7 on the axis X of drive shaft 3. A cam surface 7*c* of rockable cam 7 is comprised of a base-circle surface, a circular-arc shaped ramp surface extending from the base-circle surface to a cam-nose portion 7*a*, a top surface that provides a maximum valve lift, and a lift surface by which the ramp surface and the top surface are joined. The base-circle surface, the ramp surface, the lift surface, and the top surface abut predetermined positions of the upper surface of valve lifter 6, depending on the oscillatory position of rockable cam 7. As shown in FIGS. 5 and 6, multinodular-link motion-transmission mechanism 8 includes a rocker arm 13 laid out above drive shaft 3, a link arm 14 mechanically linking one end 13*a* (a first armed portion) of rocker arm 13 to drive cam 5, and a link rod 15 mechanically linking the other end 13*b* (a second armed portion) of rocker arm 13 to the cam-nose portion 7*a* of one of rockable cams 7, 7.

Rocker arm 13 is formed with an axially-extending center bore 13*c* (a through opening). Rocker-arm center bore 13*c* is rotatably fitted onto the outer periphery of a control cam 18 (described later), to cause a pivotal motion (or an oscillating motion) of rocker arm 13 on the axis P1 of control cam 18 (see FIG. 5). As seen in FIG. 6, rocker arm 13 has the first armed portion 13*a* extending from the axial center bore portion in a first radial direction and the second armed portion 13*b* extending from the axial center bore portion in a second radial direction substantially opposite to the first radial direction. Rocker arm 13 has an axially-extending pin 19 (a pivot) that axially protrudes from the left-hand side wall surface (viewing FIG. 5) of the first armed portion 13*a*. Pivot pin 19 is integrally formed with rocker arm 13. Rocker arm 13 is also formed with a connecting-pin hole 13*d* bored in the second armed portion 13*b* into which a connecting pin 20 is fitted. That is, by means of connecting pin 20, a first forked end 15*a* of link rod 15 is mechanically linked to the second armed portion 13*b* of rocker arm 13.

Link arm 14 is comprised of a large-diameter annular portion 14*a* and a small-diameter protruding end portion 14*b* radially outwardly extending from a predetermined portion of the outer periphery of large-diameter annular portion 14*a*. Large-diameter annular portion 14*a* is formed with a first fitted bore (or a drive-cam retaining bore) 14*c*, which is rotatably fitted onto the outer peripheral surface 5*b* of drive cam 5. On the other hand, small-diameter protruding end portion 14*b* is formed with a connecting-pin hole 14*d* (a through opening or a second fitted bore) into which pin 19 is rotatably fitted.

Link rod 15 is substantially C-shaped in lateral cross section (see FIGS. 5 and 6), to balance contradictory requirements, that is, light weight (or compactness), and high rigidity. The first forked portion 15*a* of link rod 15 is rotatably linked to the second armed portion 13*b* of rocker arm 13 via connecting pin 20. On the other hand, the second forked portion 15*b* of link rod 15 is rotatably linked to the cam-nose portion 7*a* of rockable cam 7 via a connecting pin 21.

As clearly shown in FIGS. 5 and 6, control mechanism 9 includes a control shaft 17 located above and arranged in parallel with drive shaft 3 and control cam 18 serving as a fulcrum of oscillating motion of rocker arm 13 and attached to the outer periphery of control shaft 17. Control cam 18 is integrally formed with control shaft 17 so that control cam 18 (eccentric cam) is fixed onto the outer periphery of control shaft 17. Control shaft 17 is rotatably supported on cylinder head 1 by means of bearing members (not shown). Control shaft 17 is driven within a predetermined angular range by means of a geared direct-current (DC) motor or an electric control-shaft actuator (not shown) so as to change the initial position of multinodular-link motion-transmission mechanism 8. Control cam 18 is formed as an eccentric cam having a cylindrical cam profile. The axis (the geometric center) P1 of control cam 18 is displaced a predetermined distance from the axis P2 of control shaft 17. In order to determine the angular position of control shaft 17 based on engine operating conditions, the control-shaft actuator is driven in response to a control command signal from a control-shaft controller or an electronic control unit, often abbreviated to "ECU". The ECU generally comprises a microcomputer. The ECU includes an input/output interface (I/O), memories (RAM, ROM), and a microprocessor or a central processing unit (CPU). The input/output interface (I/O) of the ECU receives input information from various engine/vehicle sensors, for example, a crank-angle sensor (or a crankshaft position sensor), an airflow meter, an engine temperature sensor (or an engine coolant temperature sensor), and a control-shaft position sensor. The crank-angle sensor is provided to inform the ECU of the engine speed as well as the relative position of the crankshaft. The airflow meter is provided to detect the quantity of air drawn into the engine. The engine temperature sensor is provided to detect the actual operating temperature of the engine. The control-shaft position sensor is generally constructed by a potentiometer that generates a voltage signal corresponding to the angular position of control shaft 17. Within the ECU, the central processing unit (CPU) allows the access by the I/O interface of input informational data signals from the previously-discussed engine/vehicle sensors. The CPU of the ECU is responsible for carrying the control-shaft position control program stored in memories and is capable of performing necessary arithmetic and logic operations needed to determine the angular position of control shaft 17 depending on the engine operating conditions for control-shaft position control achieved through the control-shaft actuator (the geared-DC motor). Computational results (arithmetic calculation results), that is, calculated output signal is relayed through the output interface circuitry of the ECU to an output stage, namely the control-shaft actuator.

The improved lubricating system of the valve operating apparatus of the embodiment has a lubricating-oil supply circuit hereunder described in detail in reference to FIGS. 1–4, so as to supply lubricating oil into the clearance space defined between the outer peripheral surface 5*b* of drive cam 5 and the inner peripheral surface of first bore 14*c* of link arm 14 and further supply lubricating oil into the clearance space defined between the outer peripheral surface of pin 19 of rocker arm 13 and the inner peripheral surface of connecting-pin hole 14*d* (the second bore) of link arm 14.

As can be seen from the cross section of FIG. 1, the lubricating-oil supply circuit of the lubricating system is mainly comprised of a radial oil hole 22, an axial oil passage 23, and first and second communicating passages 24 and 25. Radial oil hole 22 (a through opening) is formed in the sleeve-like camshaft 4 substantially midway of large-diameter cylindrical journal portion 4*a* in such a manner as to extend in the radial direction perpendicular to the axial direction of drive shaft 3. Axial oil passage 23 is formed in drive shaft 3. A portion of the circumferential wall of the cylindrical-hollow drive shaft 3, corresponding to the thinnest walled portion of drive cam 5, is formed with a radially-bored, large-diameter oil passage 24*a* whose innermost opening end communicates axial oil passage 23. On the other hand, the thinnest walled portion of drive cam 5 is formed with a radially-bored, small-diameter oil passage 24*b* whose innermost opening end communicates large-diameter oil passage 24*a*. As described later, the outermost opening end of small-diameter radial oil passage 24*b* of drive cam 5 is properly communicated with second communicating passage 25 via the clearance space defined between the inner peripheral surface of bore 14*c* of link arm 14 and the outer peripheral surface 5*b* of drive cam 5, or the outermost opening end of small-diameter radial oil passage 24*b* of drive cam 5 is directly communicated with second communicating passage 25 in a fluid-communication established state shown in FIGS. 3 and 4 in which drive cam 5 is conditioned in the aligned drive-cam rotary position and thus second communicating passage 25 is directly communicated with small-diameter oil passage 24*b* of first communicating passage 24. That is, as will be hereinafter described in detail in reference to FIGS. 3 and 4, second communicating passage 25 is selectively communicated directly with small-diameter oil passage 24*b* of first communicating passage 24 depending on the angular position of drive cam 5. In the shown embodiment, the axis of large-diameter oil passage 24*a* of drive shaft 3 and the axis of small-diameter oil passage 24*b* of drive cam 5 are coaxially arranged with each other. Large-diameter radial oil passage 24*a* of drive shaft 3 and small-diameter radial oil passage 24*b* of drive cam 5 construct first communicating passage 24 (see FIGS. 1–3). Second communicating passage 25 is formed in link arm 14 to intercommunicate the bore 14*c* and connecting-pin hole 14*d* of link arm 14 (see FIGS. 1–3). Radial oil hole 22 communicates with a cylinder-head oil gallery through an oil passage (not shown) formed in each of the drive-shaft bearing members and communicating the cylinder-head oil gallery. As clearly shown in FIG. 1, the circumferential wall of drive shaft 3 is also formed with a radially-extending additional oil passage 26. Radial oil hole 22 communicates with axial oil passage 23 via additional radial oil passage 26. In the shown embodiment, radial oil hole 22 and additional radial oil passage 26 are arranged coaxially with each other. As viewed from the lateral cross section of FIGS. 2 and 3, second communicating passage 25 is bored or formed along the line segment interconnecting both of the center of first bore 14*c* of link arm 14 and the center of connecting-pin hole (second bore) 14*d* of link arm 14. One opening end 25*a* of second communicating passage 25 opens to a portion of the inner peripheral wall of first bore 14*c* closest to connecting-pin hole (second bore) 14*d*, whereas the other opening end 25*b* of second communicating passage 25 opens to a portion of the inner peripheral wall of connecting-pin hole (second bore) 14*d* closest to first bore 14*c*. As viewed from the longitudinal cross section of FIG. 1, second communicating passage 25 is formed as an oblique oil passage, which is inclined with respect to the radial direction perpendicular to the axial direction of drive shaft 3 parallel to the two parallel axes of first and second bores 14*c* and 14*d* of link arm 14. In other words, the oblique oil passage (second communicating passage 25) is inclined with respect to a direction of the longitudinal axis of link arm 14 and formed as an oblique circular cylinder in geometry and in longitudinal cross section (see FIG. 1). As can be appreciated from comparison between the drawings (FIGS. 1 and 2) showing the fluid-communication blocked state (or the misaligned drive-cam rotary position) and the drawings (FIGS. 3 and 4) showing the fluid-communication established state (or the aligned drive-cam rotary position), when drive cam 5 is positioned or conditioned in the aligned drive-cam rotary position, the first opening end 25*a* of second communicating passage 25 is communicated with small-diameter oil passage 24*b* of first communicating passage 24 (see FIGS. 3 and 4). Additionally, in the valve operating apparatus of the embodiment, in an engine stopped state, the angular position of drive cam 5 is controlled so that small-diameter oil passage 24*b* of first communicating passage 24 is out of alignment with the first opening end 25*a* of second communicating passage 25. That is, in the engine stopped state, the first opening end 25*a* of second communicating passage 25 is closed by the outer peripheral surface 5*b* of drive cam 5 (see FIGS. 1 and 2).

In addition to the previously-discussed lubricating-oil supply circuit mainly comprised of radial oil hole 22, axial oil passage 23, and first and second communicating passages 24 and 25, an additional lubricating-oil supply circuit is provided for lubrication of the contact portion between the inner peripheral surface of axial center bore 13*c* of rocker arm 13 and the outer peripheral surface of control cam 18. Concretely, the additional lubricating-oil supply circuit is mainly comprised of an axial oil passage 30 formed in control shaft 17 and a radial oil hole 31 formed in control cam 18 formed integral with control shaft 17.

The valve operating apparatus of the embodiment operates as follows.

At low-load operation in which low valve-lift control is required, control shaft 17 is rotated in one rotation direction by the actuator in response to a control signal generated from the ECU and corresponding to a control-shaft angular position suited for a certain low valve lift determined based on the current engine operating condition (the low-load operation). The thick-walled portion of control cam 18 rotates in the one rotation direction together with control shaft 17, so that the axis P1 of control cam 18 revolves round the axis P2 of control shaft 17. As a result of this, control cam 18 (or control shaft 17) is kept at the angular position suited for the certain low valve lift. Therefore, the first armed portion 13*a* of rocker arm 13 moves downwards with respect to control shaft 17, while the second armed portion 13*b* of rocker arm 13 moves upwards. The upward movement of second armed portion 13*b* forces the cam-nose portion 7*a* of rockable cam 7 up via link rod 15, and thus rockable cam 7 rotates in the counterclockwise direction (viewing FIG. 5). Under these conditions, when link arm 14 pushes up the first armed portion 13*a* of rocker arm 13 due to rotary motion of drive cam 5, the pushing-up motion (input motion) of first armed portion 13*a* is further transmitted through the second armed portion 13*b* of rocker arm 13, link rod 15 and rockable cam 7 to valve lifter 6, but a lifted height of valve lifter 6 becomes comparatively small. The comparatively small lifted height of valve lifter 6 causes a small valve lift of intake valve 2, thus resulting in a retardation in an intake valve open timing (IVO) and reduces a valve overlap period during which the open periods of intake and exhaust valves are overlapped. This contributes to the improved fuel economy (low fuel consumption) and stable engine operation (stable combustion) in a low engine load range.

Conversely, at high-load operation in which high valve-lift control is required, control shaft 17 is rotated in the other rotational direction by the actuator in response to a control signal corresponding to a control-shaft angular position suited for a certain high valve lift determined based on the current engine operating condition (the high-load operation). The thick-walled portion of control cam 18 rotates in the other rotation direction together with control shaft 17, so that the axis P1 of control cam 18 revolves round the axis P2 of control shaft 17. As a result, control cam 18 (or control shaft 17) is kept at the angular position suited for the certain high valve lift. Therefore, the first armed portion 13*a* of rocker arm 13 moves upwards with respect to control shaft 17, while the second armed portion 13*b* of rocker arm 13 moves downwards. The downward movement of second armed portion 13*b* forces the cam-nose portion 7*a* of rockable cam 7 down via link rod 15, and thus rockable cam 7 rotates in the clockwise direction (viewing FIG. 5). Therefore, the contact points of the cam surfaces 7*c*, 7*c* of rockable cams 7, 7 in contact with the respective upper surfaces of valve lifters 6, 6, move towards cam-nose portions 7*a*, 7*a*. Under these conditions, when link arm 14 pushes up the first armed portion 13*a* of rocker arm 13 due to rotary motion of drive cam 5, a lifted height of each valve lifter 6 becomes comparatively large. The comparatively large lifted height of valve lifter 6 causes a large valve lift of intake valve 2, thus resulting in an advancement in an intake valve open timing (IVO) and also resulting in a retardation in an intake valve closure timing (IVC), in other words, an enlarged working angle. This contributes to the enhanced charging efficiency of intake air and sufficient engine power output in a high engine load range.

The lubricating-oil supply circuit of the lubricating system of the valve operating apparatus of the embodiment operates as follows.

When assembling, the outer peripheral surface 5*b* of drive cam 5 is brought into sliding-contact directly with the inner peripheral surface of bore 14*c* of link arm 14 without any needle bearing rollers. During operation of the engine, lubricating oil, which is fed through radial oil hole 22 of camshaft 4 and radial oil passage 26 of drive shaft 3 into axial oil passage 23 of drive shaft 3, is supplied via first communicating passage 24 (that is, both of large-diameter oil passage 24*a* of drive shaft 3 and small-diameter oil passage 24*b* of drive cam 5) into the clearance defined between the inner peripheral surface of bore 14*c* of link arm 14 and the outer peripheral surface 5*b* of drive cam 5. With drive cam 5 (the eccentric cam) eccentrically rotating, on the assumption that the clearance space between the outer peripheral surface 5*b* of drive cam 5 and the inner peripheral surface of bore 14*c* of link arm 14 is exaggerated, there are (i) a narrow-spaced, comparatively high-pressure area (an area of maximum loading or a heavily loaded portion of the bearing surfaces) having an increased tendency of metal-to-metal contact between the outer peripheral surface 5*b* of drive cam 5 and the inner peripheral surface of first link-arm bore 14*c* and (ii) a crescent-shaped wide-spaced, comparatively low-pressure area (an area of light loading or a lightly loaded portion) to which a load of the rotation direction of drive cam 5 is applied. Actually, the metal-to-metal contact is avoided by supporting drive cam (eccentric cam) 5 on an oil film of lubricating oil existing in the narrow-spaced high-pressure area. The crescent-shaped wide-spaced, comparatively low-pressure area is simply referred to as "crescent-shaped clearance C". Briefly speaking, during rotary motion of drive cam 5, the clearance space between the outer peripheral surface 5*b* of drive cam 5 and the inner peripheral surface of bore 14*c* of link arm 14 is formed as a crescent-shaped clearance C. Note that the narrow-spaced, comparatively high-pressure area varies or shifts around owing to eccentric rotary motion of the eccentrically mounted drive cam 5. In other words, the crescent-shaped clearance C (the wide-spaced, comparatively low-pressure area) varies or shifts around owing to eccentric rotary motion of the eccentrically-mounted drive cam 5. During operation, the lubricating system of the embodiment delivers a continuous supply of lubricating oil to the lightly loaded portion of the bearing surfaces, that is, crescent-shaped clearance C via the first communicating passage 24 (large-diameter radial oil passage 24*a* of drive shaft 3 and small-diameter radial oil passage 24*b* of drive cam 5), and temporarily maintained or held in the crescent-shaped clearance C. Thereafter, owing to eccentric rotary motion of the eccentrically-mounted drive cam 5, the narrow-spaced high-pressure area varies or shifts in the direction of rotation of drive cam 5 to perform pumping. Thus, the moment that crescent-shaped clearance C communicates with the opening end 25*a* of second communicating passage 25 during rotary motion of drive cam 5, a sufficient amount of lubricating oil in crescent-shaped clearance C is forced or pumped into second communicating passage 25. And then, the lubricating oil pumped into second communicating passage 25 is adequately introduced into the clearance space between the outer peripheral surface of pin 19 of rocker arm 13 and the inner peripheral surface of second link-arm bore 14*d*. Such an oscillatory pumping action created by eccentric rotary motion of the eccentrically-mounted drive cam 5 within first link-arm bore 14*c* enhances the ability to lubricate the clearance space between the inner peripheral surface of first link-arm bore 14*c* and the outer peripheral surface 5*b* of drive cam 5. Additionally, the oscillatory pumping action prevents the lubricating performance for the clearance between the inner peripheral surface of first link-arm bore 14*c* and the outer peripheral surface 5*b* of drive cam 5 from being lowered.

Figure 4:
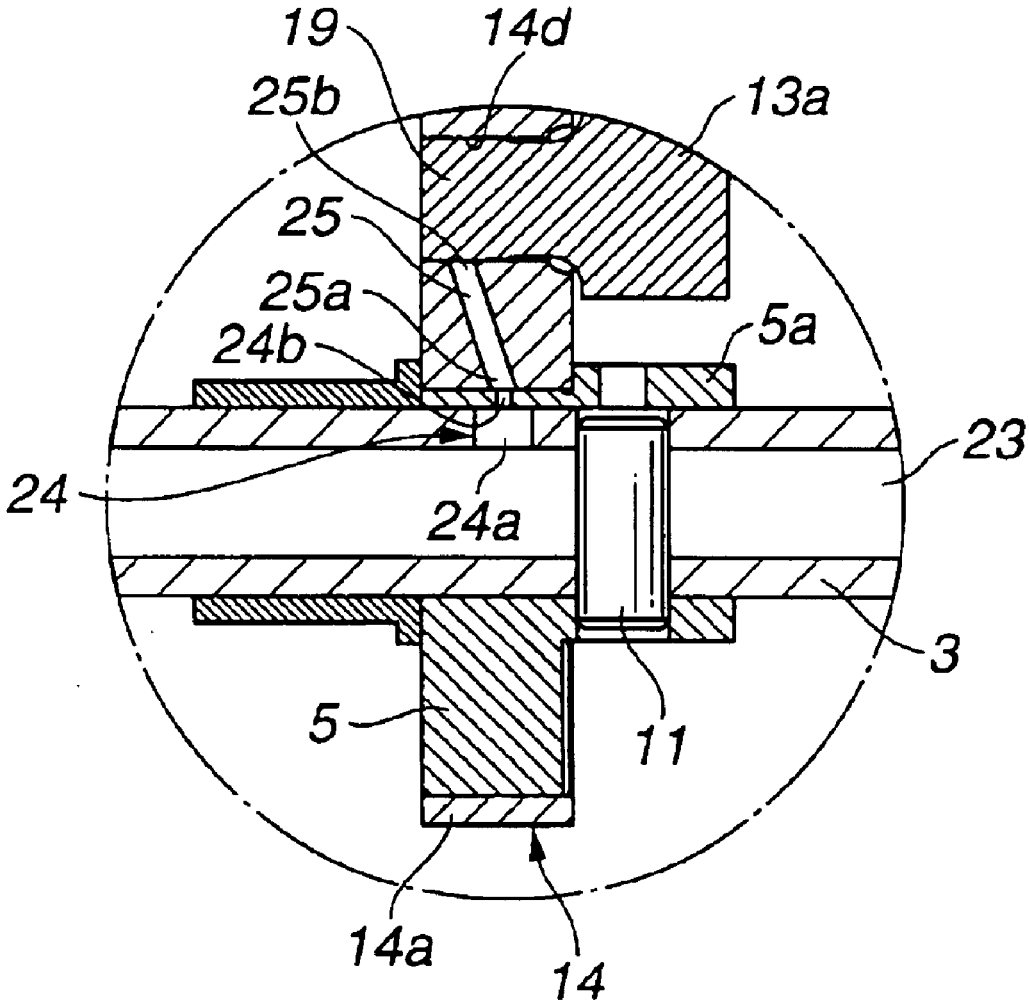
FIG. 4 is a longitudinal cross-sectional view illustrating the essential part of the valve operating apparatus of the embodiment, that is, the mechanically-linked portions among a drive cam, a link arm, and a rocker arm, in the fluid-communication established state (or in the aligned drive-cam rotary position) shown in FIG. 3.

As can be appreciated from the fluid-communication established state shown in FIGS. 3 and 4 in which drive cam 5 is conditioned in the aligned drive-cam rotary position and thus the first opening end 25*a* of second communicating passage 25 is communicated with small-diameter oil passage 24*b* of first communicating passage 24, lubricating oil is directly supplied from first communicating passage 24 to second communicating passage 25, thereby insuring a high lubricating performance for the clearance space between the inner peripheral surface of first link-arm bore 14*c* and the outer peripheral surface 5*b* of drive cam 5.

As set forth above, as viewed from the longitudinal cross section of FIG. 1, second communicating passage 25 is formed as an oblique oil passage, which is inclined with respect to the radial direction perpendicular to the axial direction of drive shaft 3. Forming second communicating passage 25 as an oblique oil passage means a comparatively long oil passage. That is, the obliquely-bored second communicating passage enhances the capacity to maintain or hold or store lubricating oil in second communicating passage 25. Due to the enhanced lubricating-oil holding capacity, it is possible to readily supply the lubricating oil temporarily stored in second communicating passage 25 into the clearance space between the inner peripheral surface of first link-arm bore 14*c* and the outer peripheral surface 5*b* of drive cam 5 even during the engine restarting period. As compared to the vertically-bored oil passage, the previously-noted obliquely-bored oil passage (second communicating passage 25) has a relatively greater entire inner peripheral wall surface area, in other words, a relatively high fluid-flow resistance. Thus, the obliquely-bored oil passage (second communicating passage 25) is superior to the vertically-bored oil passage in the lubricating-oil holding performance. Therefore, it is possible to prevent the lubricating oil from flowing from second communicating passage 25 back to the clearance space between the inner peripheral surface of first link-arm bore 14*c* and the outer peripheral surface 5*b* of drive cam 5 and then flowing out in the opposite axial directions of drive cam 5 after the engine has been stopped.

Also, as can be seen from the cross sections of FIGS. 1 and 2, in the engine stopped state, the angular position of drive cam 5 is controlled so that small-diameter oil passage 24*b* of first communicating passage 24 is out of alignment with the first opening end 25*a* of second communicating passage 25, and the first opening end 25*a* of second communicating passage 25 is closed by the outer peripheral surface 5*b* of drive cam 5 to realize the fluid-communication blocked state. Thus, it is possible to store the lubricating oil in second communicating passage 25 for a comparatively long time period, thus insuring a ready supply of lubricating oil from second communicating passage 25 into the clearance space between the inner peripheral surface of first link-arm bore 14*c* and the outer peripheral surface 5*b* of drive cam 5 even during engine restarting periods. The total lubricating performance of the lubricating system is further improved.

Furthermore, in the lubricating system of the valve operating apparatus of the embodiment, the additional lubricating-oil supply circuit (containing axial oil passage 30 formed in control shaft 17 and radial oil hole 31 formed in control cam 18) is also provided for lubrication of the contact portion between the inner peripheral surface of axial center bore 13*c* of rocker arm 13 and the outer peripheral surface of control cam 18, thereby enhancing the lubricating performance for the clearance between the inner peripheral surface of axial center bore 13*c* of rocker arm 13 and the outer peripheral surface of control cam 18.

In the valve operating apparatus of the embodiment employing the improved lubricating system discussed above, rocker arm 13 is pivotably supported on the outer peripheral surface of control cam (eccentric cam) 18 eccentrically fixed to the outer periphery of control shaft 17. That is, the control shaft and the control cam are provided to change the attitude (the center of oscillating motion) of rocker arm 13 depending on the engine operating condition. The associated one of rockable cams 7, 7 is mechanically linked to the second armed portion 13*b* via link rod 15 to cause the engine valve (intake valve 2) to open and close. The center of oscillating motion of (pivotal motion) of rocker arm 13 is changed by controlling and actuating the control shaft 17 and control cam 18) depending on the engine operating condition, and as a result the sliding-contact positions of rockable cams 7, 7 with respect to the respective engine valves 2, 2, exactly the respective engine-valve lifters 6, 6 are also varied. In this manner, the valve lift of each engine valve (each intake valve 2) can be variably controlled. Variably controlling the valve lift of the engine valve depending on the engine operating condition enables the engine valve overlap to be properly decreasingly compensated for during low valve-lift control, thereby ensuring improved fuel economy (low fuel consumption) and stable engine operation (stable combustion) at low-load operation. Variably controlling the valve lift of the engine valve depending on the engine operating condition also enables the working angle (the valve open period) of the engine valve (intake valve 2) to be properly increasingly compensated for during high valve-lift control, thereby enhancing a charging efficiency of intake air and ensuring sufficient engine power output at high-load operation.

In the shown embodiment, the improved lubricating system is applied to the intake-valve side. It will be appreciated that the fundamental concept of the improved lubricating system incorporated in the valve operating apparatus of the embodiment may be applied to the exhaust-valve side. Moreover, the improved lubricating system is applied for lubricating purposes for moving link components of the multinodular-link motion-transmission mechanism of the variable valve operating apparatus with the VEL control system. It will be understood that the fundamental concept of the improved lubricating system may be applied to a standard valve operating apparatus employing neither a variable valve timing control system (VTC), nor a variable valve lift system (VVL), nor a continuous variable valve event and lift control system (VEL).

The entire contents of Japanese Patent Application No. 2003-86745 (filed Mar. 27, 2003) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A valve operating apparatus of an internal combustion engine for causing an engine valve to open and close, comprising:

a drive shaft having an oil passage formed therein;

a drive cam, which is integrally fixed to an outer periphery of the drive shaft and whose axis is eccentric to an axis of the drive shaft;

a link arm formed at one end with a bore rotatably fitted onto an outer peripheral surface of the drive cam;

a rocker arm having a first armed portion that is rotatably fitted to the other end of the link arm via a pivotally linked portion between the link arm and the rocker arm, and a second armed portion through which the engine valve is opened and closed by oscillating motion of the rocker arm;

a lubricating system comprising:

(a) a first communicating passage formed in the drive cam and having a first opening end communicating the oil passage formed in the drive shaft; and (b) a second communicating passage formed in the link arm and having a first opening end opening to an inner peripheral surface of the bore of the link arm for proper fluid communication with a second opening end of the first communicating passage, and having a second opening end opening to the pivotally linked portion between the link arm and the rocker arm; and a clearance space defined between the outer peripheral surface of the drive cam and the inner peripheral surface of the bore of the link arm is formed as a crescent-shaped clearance except an area of maximum loading during rotary motion of the drive cam.

2. The valve operating apparatus as claimed in claim 1, wherein:

the second communicating passage is formed as an oblique oil passage with respect to a direction of a longitudinal axis of the link arm.

3. The valve operating apparatus as claimed in claim 2, wherein:

the first opening end of the second communicating passage is set in a substantially closed position in which the first opening end is substantially closed by the outer peripheral surface of the drive cam in an engine stopped state.

4. The valve operating apparatus as claimed in claim 1, wherein:

the drive cam comprises a disk-shaped eccentric cam portion, which is formed integral with the drive shaft so that the axis of the drive cam is displaced a predetermined offset from the axis of the drive shaft.

5. The valve operating apparatus as claimed in claim 4, further comprising:

a securing pin, and wherein the drive cam has a cylindrical portion integrally formed with the disk-shaped eccentric cam portion and protruding from one side wall of the disk-shaped eccentric cam portion, and the cylindrical portion is fixedly connected onto the drive shaft via the securing pin.

6. The valve operating apparatus as claimed in claim 1, further comprising:

a rockable cam that causes the engine valve to open and close; and a link rod mechanically linking the second armed portion of the rocker arm to the rockable cam, and wherein the oscillating motion of the rocker arm is transmitted through the link rod to the rockable cam to cause oscillating motion of the rockable cam, and the oscillating motion of the rockable cam is converted into an opening and closing motion of the engine valve.

7. The valve operating apparatus as claimed in claim 6, further comprising:

a first connecting pin and a second connecting pin, and wherein the link rod is rotatably linked at one end to the second armed portion of the rocker arm via the first connecting pin and rotatably linked at the other end to the rockable cam via the second connecting pin.

8. The valve operating apparatus as claimed in claim 7, further comprising:

a third connecting pin, and wherein the one end of the link arm is formed as an annular portion, and the other end of the link arm is formed as a protruding end portion extending from a predetermined portion of an outer periphery of the annular portion, and wherein the annular portion is formed with the bore rotatably fitted onto the outer peripheral surface of the drive cam, and the protruding end portion is formed with a connecting-pin hole into which the third connecting pin is rotatably fitted.

9. The valve operating apparatus as claimed in claim 1, wherein:

the oil passage is formed as an axial oil passage extending in an axial direction of the drive shaft.

10. The valve operating apparatus as claimed in claim 1, wherein:

the first communicating passage is defined in a portion of the drive cam having a thinnest wall thickness.

11. The valve operating apparatus as claimed in claim 10, wherein:

the first communicating passage is formed in (i) a portion of a circumferential wall of the drive shaft corresponding to the thinnest walled portion of the drive cam and (ii) the thinnest walled portion of the drive cam, both being continuous with each other and extending in a radial direction perpendicular to an axial direction of the drive shaft.

12. The valve operating apparatus as claimed in claim 11, wherein:

the first communicating passage comprises:

(a) a radially-bored, large-diameter oil passage formed in the circumferential wall of the drive shaft and communicating with the oil passage; and (b) a radially-bored, small-diameter oil passage formed in the thinnest walled portion of the drive cam to be continuous with the large-diameter oil passage.

13. The valve operating apparatus as claimed in claim 1, wherein:

lubricating oil is supplied from a cylinder-head oil gallery of a cylinder head into the oil passage through an oil hole formed in a camshaft journal portion.

14. The valve operating apparatus as claimed in claim 1, further comprising:

a rockable cam that causes the engine valve to open and close;

a link rod mechanically linking the second armed portion of the rocker arm to the rockable cam; and a control shaft and a control cam eccentrically fixed to an outer periphery of the control shaft for changing a center of the oscillating motion of the rocker arm, and wherein the rocker arm is pivotably supported on an outer peripheral surface of the control cam, and the rockable cam is mechanically linked to the second armed portion via the link rod to cause the engine valve to open and close, and the center of the oscillating motion of the rocker arm is changed by controlling and actuating the control shaft and the control cam depending on an engine operating condition so as to vary a sliding-contact position of the rockable cam with respect to the engine valve and vary a valve lift of the engine valve.

15. A valve operating apparatus of an internal combustion engine for causing an engine valve to open and close, comprising:

a drive shaft having an oil passage formed therein;

a drive cam, which is integrally fixed to an outer periphery of the drive shaft and whose axis is eccentric to an axis of the drive shaft;

a link arm formed at one end with a bore rotatably fitted onto an outer peripheral surface of the drive cam;

a rocker arm having a first armed portion that is rotatably fitted to the other end of the link arm via a pivotally linked portion between the link arm and the rocker arm, and a second armed portion through which the engine valve is opened and closed by oscillating motion of the rocker arm;

a lubricating system comprising:

(a) a first communicating passage formed in the drive cam and having a first opening end communicating the oil passage formed in the drive shaft; and (b) a second communicating passage formed in the link arm and having a first opening end opening to an inner peripheral surface of the bore of the link arm for proper fluid communication with a second opening end of the first communicating passage, and having a second opening end opening to the pivotally linked portion between the link arm and the rocker arm; and the outer peripheral surface of the drive cam is in sliding-contact directly with the inner peripheral surface of the bore of the link arm, and lubricating oil supplied from the oil passage through the first communicating passage into a clearance space defined between the outer peripheral surface of the drive cam and the inner peripheral surface of the bore of the link arm is forcibly supplied into the second communicating passage by an oscillatory pumping action created by eccentric rotary motion of the drive cam within the bore of the link arm.

16. The valve operating apparatus as claimed in claim 15, wherein:

the second communicating passage is formed as an oblique oil passage with respect to a direction of a longitudinal axis of the link arm.

17. The valve operating apparatus as claimed in claim 16, wherein:

the first opening end of the second communicating passage is set in a substantially closed position in which the first opening end is substantially closed by the outer peripheral surface of the drive cam in an engine stopped state.

18. The valve operating apparatus as claimed in claim 15, wherein:

the drive cam comprises a disk-shaped eccentric cam portion, which is formed integral with the drive shaft so that the axis of the drive cam is displaced a predetermined offset from the axis of the drive shaft.

19. The valve operating apparatus as claimed in claim 15, further comprising:

a rockable cam that causes the engine valve to open and close;

a link rod mechanically linking the second armed portion of the rocker arm to the rockable cam; and a control shaft and a control cam eccentrically fixed to an outer periphery of the control shaft for changing a center of the oscillating motion of the rocker arm, and wherein the rocker arm is pivotably supported on an outer peripheral surface of the control cam, and the rockable cam is mechanically linked to the second armed portion via the link rod to cause the engine valve to open and close, and the center of the oscillating motion of the rocker arm is changed by controlling and actuating the control shaft and the control cam depending on an engine operating condition so as to vary a sliding-contact position of the rockable cam with respect to the engine valve and vary a valve lift of the engine valve.

20. A valve operating apparatus of an internal combustion engine for causing an engine valve to open and close, comprising:

a drive shaft having an oil passage formed therein;

a drive cam, which is integrally fixed to an outer periphery of the drive shaft and whose axis is eccentric to an axis of the drive shaft;

a link arm formed at one end with a bore rotatably fitted onto an outer peripheral surface of the drive cam;

a rocker arm having a first armed portion that is rotatably fitted to the other end of the link arm via a pivotally linked portion between the link arm and the rocker arm, and a second armed portion through which the engine valve is opened and closed by oscillating motion of the rocker arm;

a lubricating system comprising:

(a) first communicating passage means formed in the drive cam and having a first opening end communicating the oil passage formed in the drive shaft for lubricating a clearance space defined between the outer peripheral surface of the drive cam and an inner peripheral surface of the bore of the link arm; and (b) second communicating passage means formed in the link arm and having a first opening end opening to the inner peripheral surface of the bore of the link arm for proper fluid communication with a second opening end of the first communicating passage means, and having a second opening end opening to the pivotally linked portion between the link arm and the rocker arm for lubricating the pivotally linked portion between the link arm and the rocker arm; and the outer peripheral surface of the drive cam is in sliding-contact directly with the inner peripheral surface of the bore of the link arm, and lubricating oil supplied from the oil passage through the first communicating passage means into the clearance space defined between the outer peripheral surface of the drive cam and the inner peripheral surface of the bore of the link arm is forcibly supplied into the second communicating passage means by an oscillatory pumping action created by eccentric rotary motion of the drive cam within the bore of the link arm.

* * * * *